US012595673B2

(12) United States Patent
Qian et al.

(10) Patent No.: US 12,595,673 B2
(45) Date of Patent: Apr. 7, 2026

(54) BEAM-COLUMN JOINT OF PREFABRICATED SELF-CENTERING RC FRAME BASED ON SMA MATERIAL

(71) Applicant: Zhengzhou University, Zhengzhou City (CN)

(72) Inventors: Hui Qian, Zhengzhou City (CN); Yifei Shi, Zhengzhou City (CN); Zong'ao Li, Zhengzhou City (CN); Xiangyu Wang, Zhengzhou City (CN); Enfeng Deng, Zhengzhou City (CN); Jundong GAo, Zhengzhou City (CN); Xun Zhang, Zhengzhou City (CN); Yingyang Liu, Zhengzhou City (CN); Xiaoyan Yang, Zhengzhou City (CN); Yuan Fang, Zhengzhou City (CN); Dakuo Feng, Zhengzhou City (CN); Qunshan Su, Zhengzhou City (CN); Zhongshan Zhang, Zhengzhou City (CN)

(73) Assignee: ZHENGZHOU UNIVERSITY, Zhengzhou City (CN)

( * ) Notice: Subject to any disclaimer, the term of this patent is extended or adjusted under 35 U.S.C. 154(b) by 367 days.

(21) Appl. No.: 18/230,883

(22) Filed: Aug. 7, 2023

(65) Prior Publication Data

US 2024/0240485 A1 Jul. 18, 2024

(30) Foreign Application Priority Data

Jan. 15, 2023 (CN) ..... 202310057711.1

(51) Int. Cl.
*E04H 9/02* (2006.01)

(52) U.S. Cl.
CPC ..... *E04H 9/0215* (2020.05)

(58) Field of Classification Search
CPC ..... E04H 9/021; E04H 9/0237; E04H 9/028; E04H 9/0215; E04H 9/024; E04H 9/027; E04B 1/98
See application file for complete search history.

(56) References Cited

U.S. PATENT DOCUMENTS 6,170,202 B1 * 1/2001 Davoodi ..... E04H 9/0237 52/573.1
8,250,818 B2 * 8/2012 Tremblay ..... E04H 9/0237 52/167.3

(Continued)

FOREIGN PATENT DOCUMENTS

CN 105672493 * 10/2016
CN 114635505 * 3/2020

(Continued)

*Primary Examiner* — Brian E Glessner
*Assistant Examiner* — Daniel J Kenny

(57) ABSTRACT

Provided is a beam-column joint of a prefabricated self-centering RC (Reinforced Concrete) frame based on an SMA (Shape Memory Alloy) material, including an RC precast column, an RC precast beam, and self-centering energy dissipation dampers arranged, and a friction energy dissipation damper. The self-centering energy dissipation damper includes an SMA kernel, an upper restraint cover plate, a lower restraint cover plate, a column-end connection reinforcing plate and a beam-end connection reinforcing plate, and a set energy dissipation gap is reserved between the SMA kernel and the upper restraint cover plate. The friction energy dissipation damper includes an in-column embedded connecting plate and a beam-end embedded connecting plate. The in-column embedded connecting plate and the beam-end embedded connecting plate each are provided with a primary connecting hole and secondary connecting holes, and each of the secondary connecting holes on the beam-end embedded connecting plate is an arc-shaped elongated hole.

20 Claims, 4 Drawing Sheets

(56) References Cited

U.S. PATENT DOCUMENTS

| | | | | |
|---|---|---|---|---|
| 2009/0126288 | A1* | 5/2009 | Fanucci | E04H 9/0237 524/440 |
| 2023/0374811 | A1* | 11/2023 | Ozbulut | E04H 9/0237 |

FOREIGN PATENT DOCUMENTS

| | | | | |
|---|---|---|---|---|
| CN | 111519967 | * | 11/2020 | |
| CN | 116290977 | * | 1/2022 | |
| WO | WO-2019031669 A1 | * | 2/2019 | F16F 7/08 |

* cited by examiner

BEAM-COLUMN JOINT OF PREFABRICATED SELF-CENTERING RC FRAME BASED ON SMA MATERIAL

CROSS REFERENCE TO RELATED APPLICATION

This patent application claims the benefit and priority of Chinese Patent Application No. 2023100577111, filed on Jan. 15, 2023, the disclosure of which is incorporated by reference herein in its entirety as part of the present application.

TECHNICAL FIELD

The present disclosure belongs to the technical field of structure engineering, and in particular to a beam-column joint of a prefabricated self-centering RC (Reinforced Concrete) frame based on an SMA (Shape Memory Alloy) material.

BACKGROUND

In recent years, prefabricated buildings have developed vigorously all over the world, and have become an alternative choice for traditional cast-in-place buildings. Compared with traditional cast-in-place concrete structures, the prefabricated buildings have the advantages of high efficiency, energy conservation and environmental protection, can develop synergistically with intelligent construction, and have industrialized properties. The plant precast building mode of prefabricated buildings determines that the seismic behavior of prefabricated concrete frame structures is different from that of traditional cast-in-place concrete frame structures. Therefore, the development of the prefabricated concrete structural system with good seismic performance has become an important research direction.

When an earthquake occurs, local damage or overall collapse of buildings is one of the most important causes of casualties and property losses. Over the past century, the seismic research of structures has made great progress. From the initial theoretical study of static method to the later study of response spectrum method, the main goal is to avoid structural collapse and reduce casualties. At this stage, the seismic design of the structure is aimed at controlling the instantaneous performance of the structure under the earthquake, that is, the usual performance requirement of "no collapse in strong earthquake". The strict seismic design ensures that the structure does not collapse under the earthquake, thus reducing casualties and economic losses. However, some strong earthquakes occurred at the end of last century have brought new warnings to the seismic research. In the Northridge earthquake in USA in 1994 and the Kobe earthquake in Japan in 1995, there were relatively few building collapses and casualties, but huge economic losses caused by the earthquakes, among which the economic losses caused by the Northridge earthquake exceeded 50 billion dollars and the economic losses caused by the Kobe earthquake exceeded 170 billion dollars, leading to extremely serious social impact. As a result, it has been gradually recognized by people that the traditional design goal of whether the building collapses after an earthquake is no longer able to meet the requirements of nowadays society. In this context, performance-based earthquake engineering (PBEE) has gradually developed, and performance-based seismic design (PBSD) has gradually become the mainstream of international earthquake engineering study.

The basic idea of the PBSD is to ensure that the response of the structure under earthquake can be controlled within the expected target range. The first generation of PBSD takes deterministic structural response as the performance target, and the performance estimation of the structure is deterministic, which does not reasonably consider the randomness and uncertainty of the earthquake action and the nonlinear behavior of the structure. The second generation of PBSD takes the overall reliability of the structure as the performance target, which considers the seismic demand of the structure and the randomness and uncertainty of the structural capacity, and gives the performance level of the structure in the form of the overall reliability. The core of the third generation of PBSD is to take seismic risk control as the ultimate performance goal, which includes not only the collapse risk assessment of the structure itself, but also the analysis of post-earthquake economic loss risk. Based on probability theory, seismic risk analysis, seismic vulnerability analysis and seismic loss analysis are incorporated into the core analysis framework, and the theoretical system is more complete. However, in nowadays highly developed urbanization, human society is still facing the challenges of great difficulty, long time and huge social cost in urban post-earthquake reconstruction. It is gradually expected by people that the structure has good seismic resilience, and can maintain or quickly restore its normal function after a strong earthquake, so as to minimize the impact of the earthquake on economic losses and society. Therefore, the study on the resilience of structures from disasters has become the focus of attention in recent years. In this context, the study on "Seismic Resilience" of structures and urban has been paid more and more attention by scholars. The seismic resilience represents the ability of structures or urban to resist the disturbance of earthquake disasters and recover quickly from the earthquake disasters.

At present, the research on seismic resilience is mainly about the self-centering structural system. Under the strong earthquake, the self-centering structure obtains the deformation resilience by means of self-weight, prestressed members or high-performance materials, so as to reduce or even completely eliminate the post-earthquake residual deformation of the structure, at the same time, the seismic energy is dissipated by damping elements, and the whole structure shows a "flag-shaped" hysteretic behavior. Compared with traditional structures, the most remarkable feature of the self-centering structures is that the post-earthquake residual deformation is small or even zero. Theoretically speaking, due to returning to the original form after the earthquake, the main body of the self-centering structure can continue to function without repairing after the earthquake, which greatly improves the possibility of continued use of a single structure after earthquake, reduces the high economic cost and great social impact caused by the strong earthquake, and promotes the rapid recovery of life and production after earthquake, which is consistent with the goal of developing earthquake-resistant and resilient cities.

At present, the research focus of prefabricated self-centering RC frame structure is mainly focused on the precast/prestressed self-centering (PPSC) structural system. In the PPSC structural system, precast members (frame beams, frame columns, wall limbs, etc.) are connected by unbonded post-tensioning (PT) prestressed tendons. Under the action of earthquake, precast members can rotate relatively to form openings, and the stretched PT prestressed tendons are used to provide self-centering ability for the structure to reduce the post-earthquake residual deformation of the structure, thus restoring the structure to the initial position. In such a process, the seismic energy absorbed by the structure is mainly dissipated by the energy dissipation (ED) elements at the joint position (such as internal energy dissipation tendons or external damping devices), so that the structure produces a typical "flag-shaped" hysteretic behavior. Although the seismic performance of this new structural system has an "attractive" advantage (the post-earthquake damage is light, and the structural function can be restored in a short time), it has not been applied to large-scale engineering after more than 20 years of research. The main reason is that the safety redundancy of this structural system is less than that of the traditional cast-in-place RC frame, precast members are connected in series mainly by unbonded prestressed tendons in the system composition, and the failure of prestressed tendons will lead to devastating consequences.

SUMMARY

To this end, an objective of the present disclosure is to provide a beam-column joint of a prefabricated self-centering RC frame based on an SMA material, avoiding a connection mode of precast members in series and the potential problem of smaller safety redundancy thereof when prestressed tendons are used to provide restoring force in the existing precast/prestressed self-centering structural system, and improving the safety of the joint of the RC frame on the basis of guaranteeing the energy dissipation and the self-centering ability of the joint of the RC frame.

In order to achieve the objective above, the technical solution adopted by the present disclosure is as follows:

A beam-column joint of a prefabricated self-centering RC frame based on an SMA material, including:

an RC precast column;

an RC precast beam;

self-centering energy dissipation dampers, where the self-centering energy dissipation dampers comprise two self-centering energy dissipation dampers arranged between the RC precast column and the RC precast beam at an interval in an up and down direction; each of the self-centering energy dissipation dampers includes an SMA kernel, an upper restraint cover plate, a lower restraint cover plate, a column-end connection reinforcing plate and a beam-end connection reinforcing plate; the SMA kernel is connected between the upper restraint cover plate and the lower restraint cover plate, and a set energy dissipation gap is reserved between the SMA kernel and the upper restraint cover plate; the column-end connection reinforcing plate is connected to both the SMA kernel and the RC precast column by column-end high-strength bolts, and the beam-end connection reinforcing plate is connected to both the SMA kernel and the RC precast beam by beam-end high-strength bolts;

a friction energy dissipation damper, including an in-column embedded connecting plate partially embedded in the RC precast column and a beam-end embedded connecting plate partially embedded in the RC precast beam, where the in-column embedded connecting plate and the beam-end embedded connecting plate each are provided with a primary connecting hole and secondary connecting holes in one-to-one correspondence; the secondary connecting holes are distributed in a circumferential direction of each of the primary connecting hole, and each of the secondary connecting holes on the beam-end embedded connecting plate is an arc-shaped elongated hole, and the primary connecting hole and the secondary connecting holes on each of the in-column embedded connecting plate and the beam-end embedded connecting plate are provided with shear bolts penetrating therethrough.

Preferably, the SMA kernel is a variable cross-section structure, including an energy dissipation section in a middle of the SMA kernel and connecting sections located at both ends of the SMA kernel. A width of the energy dissipation section is smaller than that of each of the connecting sections, the energy dissipation section is connected to the upper constraint cover plate and the lower constraint cover plate, and the connecting sections are connected to the column-end connection reinforcing plate and the beam-end connection reinforcing plate respectively.

Furthermore, the energy dissipation section is provided with an elongated hole extending in a length direction, the lower restraint cover plate is provided with pads at positions corresponding to the elongated hole and edges of the energy dissipation section in a width direction, and a thickness of each of the pads is greater than that of the energy dissipation section. The upper restraint cover plate is provided with through holes at positions corresponding to the pads.

Preferably, the thickness of each of the pads is greater than that of the energy dissipation section by 1 mm.

Preferably, the SMA kernel is made of copper-based shape memory alloy.

Preferably, the friction energy dissipation damper further includes hard friction plates attached to both sides of one end of the in-column embedded connecting plate.

Further, each of the in-column embedded connecting plate and the beam-end embedded connecting plate is provided with four secondary connecting holes; in each of the in-column embedded connecting plate and the beam-end embedded connecting plate, two secondary connecting holes on an upper side and two secondary connecting holes on a lower side are symmetrical in an up and down direction with respect to the primary connecting hole, and two secondary connecting holes on a left side and two secondary connecting holes on a right side are symmetrical in an left and right direction with respect to the primary connecting hole.

Furthermore, column-end connection reinforcing plates in self-centering energy dissipation dampers at a same position on left and right sides of a same RC precast column are connected to each other.

The present disclosure has the beneficial effects that:

1. In accordance with the present disclosure, the beam-column joint of a RC frame adopts a dry fully bolted prefabricated connection mode, which gives full play to the characteristics of efficient construction of prefabricated structures, and employs a copper-based SMA kernel with high performance and low cost to provide energy dissipation and self-centering ability for the beam-column joint of a RC frame. In addition, the construction of a plastic hinge at the beam end of the RC precast beam can improve the shear bearing capacity of the joint, enable the relative rotation between the RC precast column and the RC precast beam, and limit the maximum displacement angle of the RC frame beam-column joint, prevent the axial displacement of the self-centering energy dissipation damper from exceeding the limit, and promote the RC precast beam to participate in plastic deformation and share energy dissipation when the joint displacement angle is larger. According to the present disclosure, a connection mode of precast members in series and the potential problem of smaller safety redundancy thereof when prestressed tendons are used to provide restoring force in the existing precast/prestressed self-centering structural system are avoided.

2. The beam-column joint of a RC frame of the present disclosure can take the energy dissipation, self-centering ability and safety in consideration, and can be applied to different earthquake intensities, so as to achieve the targets of no damage in small earthquakes, easy-to-repair in moderate earthquakes, repairable in large earthquakes, no collapse in giant earthquakes. The possibility of continued use of a single structure after earthquake is improved, the high economic cost and great social impact caused by the strong earthquake can be reduced, and the rapid recovery of life and production after earthquake is accelerated.

Figure 1:
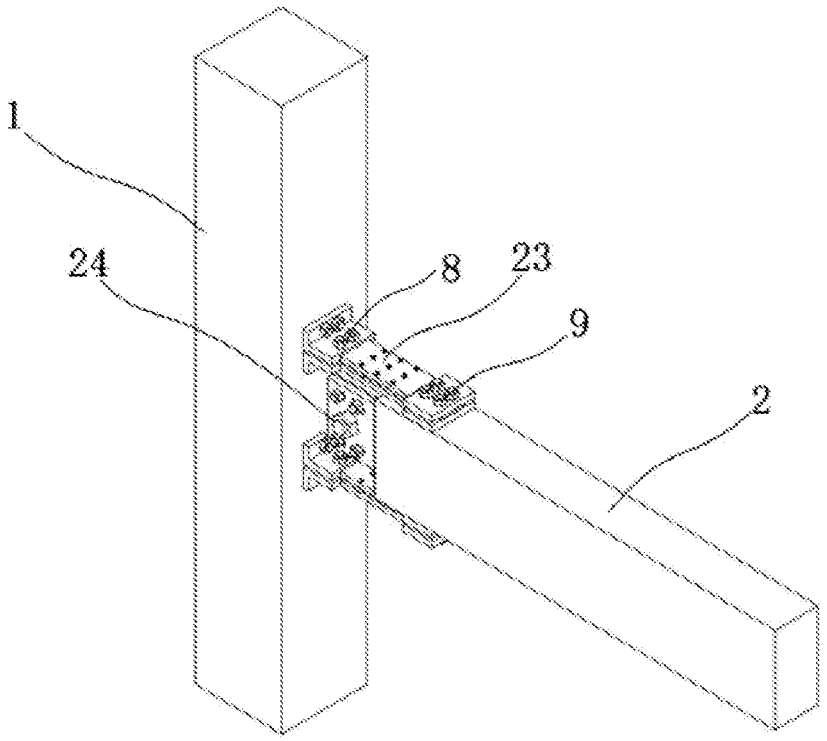
FIG. 1 is a three-dimensional schematic diagram of a beam-column joint of a prefabricated self-centering RC frame based on an SMA material in accordance with the present disclosure.

Reference signs in the drawings: 1—RC precast column, 2—RC precast beam, 3—SMA kernel, 4—upper restraint cover plate, 5—lower restraint cover plate, 6—column-end connection reinforcing plate, 7—beam-end connection reinforcing plate, 8—column-end high-strength bolt, 9—beam-end high-strength bolt, 10—in-column embedded connecting plate, 11—beam-end embedded connecting plate, 12—column primary connecting hole, 13—column secondary connecting hole, 14—beam primary connecting hole, 15—beam secondary connecting hole, 16—main shear bolt, 17—auxiliary shear bolt, 18—pad, 19—elongated hole, 20—energy dissipation section, 21—connecting section, 22—hard friction plate, 23—self-centering energy dissipation damper, 24—friction energy dissipation damper, 25—fastening high-strength bolt.

DETAILED DESCRIPTION OF THE EMBODIMENTS

The present disclosure is further described below with reference to the accompanying drawings and specific embodiments.

Figure 2:
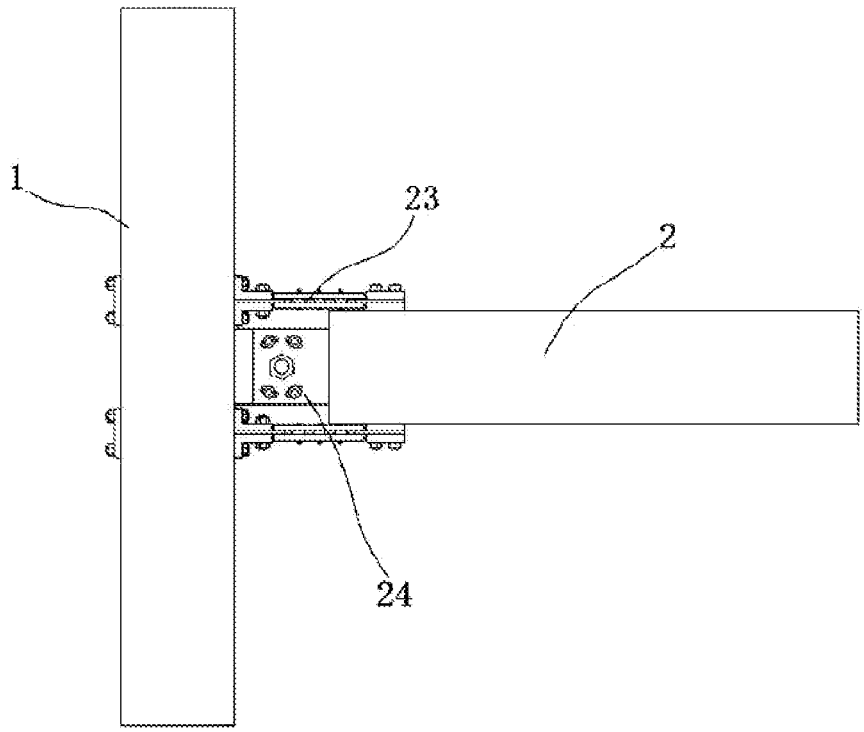
FIG. 2 is a front view of FIG. 1.

A specific embodiment of a beam-column joint of a prefabricated self-centering RC frame based on an SMA material in accordance with the present disclosure is as follows:

As shown in FIG. 1 and FIG. 2, a beam-column joint of a prefabricated self-centering RC frame based on an SMA material includes an RC precast column 1, an RC precast beam 2, and self-centering energy dissipation dampers 23 and a friction energy dissipation damper 24 which are arranged between the RC precast column 1 and the RC precast beam 2.

Figure 3:
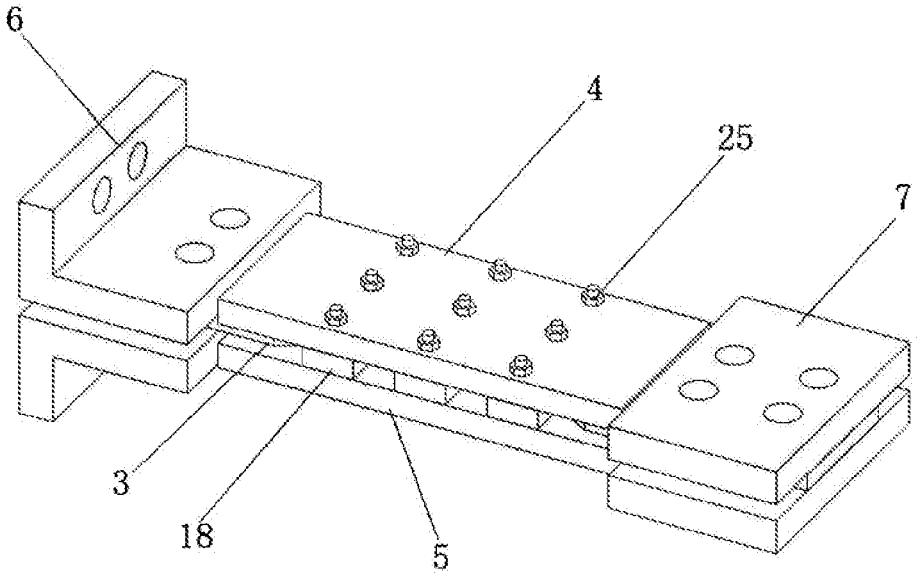
FIG. 3 is a structural schematic diagram of a self-centering energy dissipation damper of a beam-column joint of a prefabricated self-centering RC frame based on an SMA material in accordance with the present disclosure.
Figure 4:
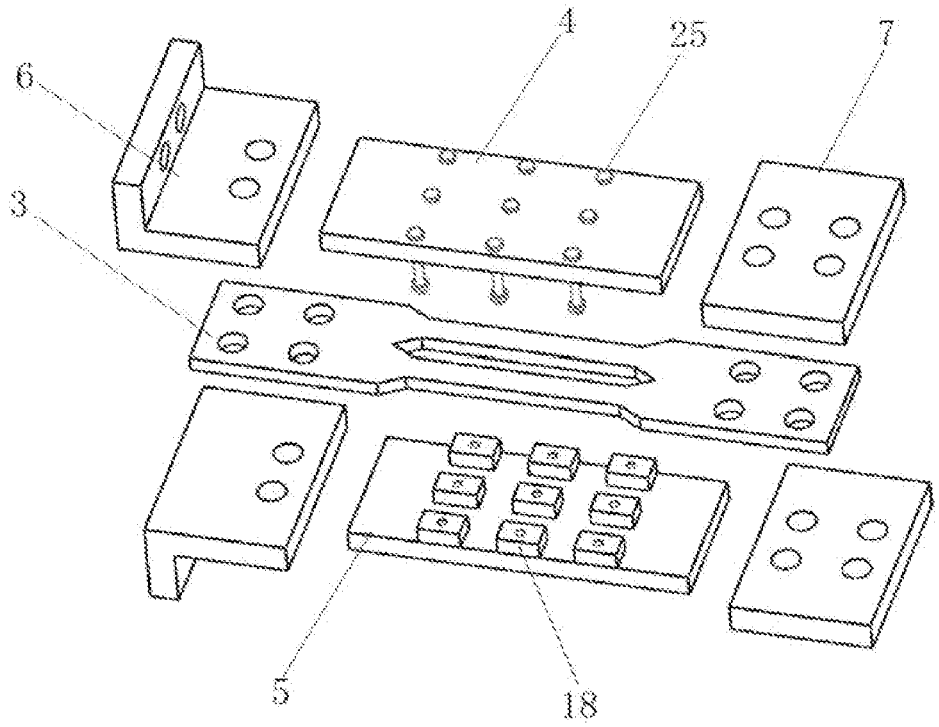
FIG. 4 is an exploded view of FIG. 3.
Figure 5:
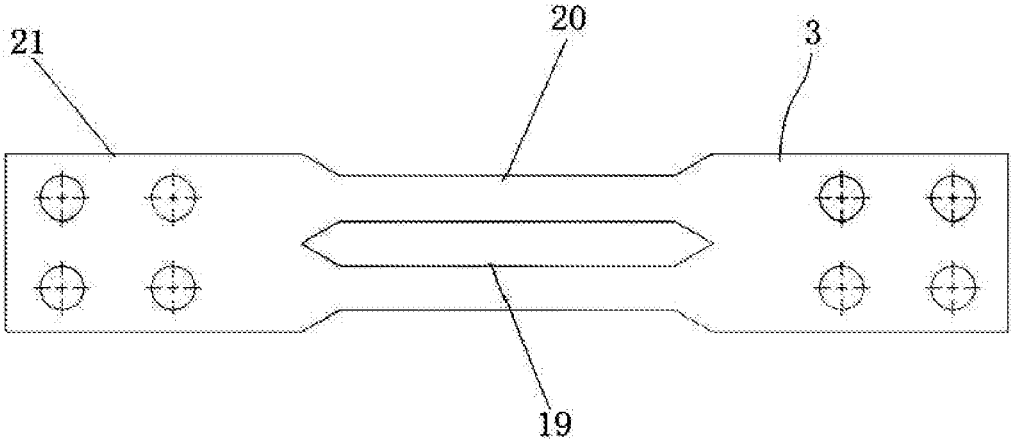
FIG. 5 is a structural schematic diagram of an SMA kernel in FIG. 3.

Specifically, as shown in FIG. 2, FIG. 3 and FIG. 4, two self-centering energy dissipation dampers 23 are arranged at intervals in an up-down direction, and each self-centering energy dissipation damper 23 includes an SMA kernel 3, an upper constraint cover plate 4, a lower constraint cover plate 5, column-end connection reinforcing plates 6, and beam-end connection reinforcing plates 7. In this embodiment, the SMA kernel 3 is made of copper-based shape memory alloy and is connected between the upper constraint cover plate 4 and the lower constraint cover plate 5. As shown in FIG. 5, the SMA kernel 3 is of a variable cross-section structure, including an energy dissipation section 20 in the middle and connecting sections 21 at both ends. The width of the energy dissipation section 20 is smaller than that of the connecting section 21. An elongated hole 19 extending in a length direction of the energy dissipation section is arranged at the middle of the energy dissipation section 20, and both ends of the elongated hole 19 are sharp ends. A row of pads 18 is provided on each of positions of the lower constraint cover plate 5 corresponding to the elongated hole 19 and edges of the energy dissipation section 20 in a width direction, and the row of pads 18 includes three pads 18 arranged at intervals. The upper constraint cover plate 4 is provided with a through hole at a position corresponding to each pad 18. The upper constraint cover plate 4, the energy dissipation section 20 and the lower constraint cover plate are connected to each other by multiple fastening high-strength bolts 25. In this embodiment, a set energy dissipation gap is reserved between the SMA kernel 3 and the upper constraint cover plate 4 as the thickness of the pad 18 is greater than that of the energy dissipation section 20. In practical applications, the thickness of the pad 18 is optimum when the thickness of the pad 18 is greater than that of the energy dissipation section 20 by 1 mm. This gap enables the SMA kernel to create a tendency for lateral deformation, and then to create a multi-wave deformation under the restraining of the upper restraining cover 4. Certainly, the gap should not be too large, and in other embodiments, it can also fluctuate up and down about 1 mm.

Two column-end connection reinforcing plates 6 are provided, which are L-shaped plates and symmetrically arranged on the upper and lower sides of one of the connecting sections. A horizontal plate section and a vertical plate section of the L-shaped plate are all provided with fixing holes. The two column-end connection reinforcing plates 6 are simultaneously connected to the corresponding connecting section of the SMA kernel 3 and the RC precast column 1 by column-end high-strength bolts 8. Two beam-end connection reinforcing plates 7 are symmetrically arranged on the upper and lower sides of the other connecting section. In two beam-end connection reinforcing plates 7 of the same self-centering energy dissipation damper 23, one of the beam-end connection reinforcing plates 7 is abutted against the surface of the RC precast beam 3, and the other of the beam-end connection reinforcing plates 7 is abutted against the surface of the corresponding connecting section of the SMA kernel. Four beam-end reinforcing plates 7 are connected to the corresponding connecting sections of the SMA kernels 3 and the RC precast beam 2 by beam-end high-strength bolts 9.

Figure 6:
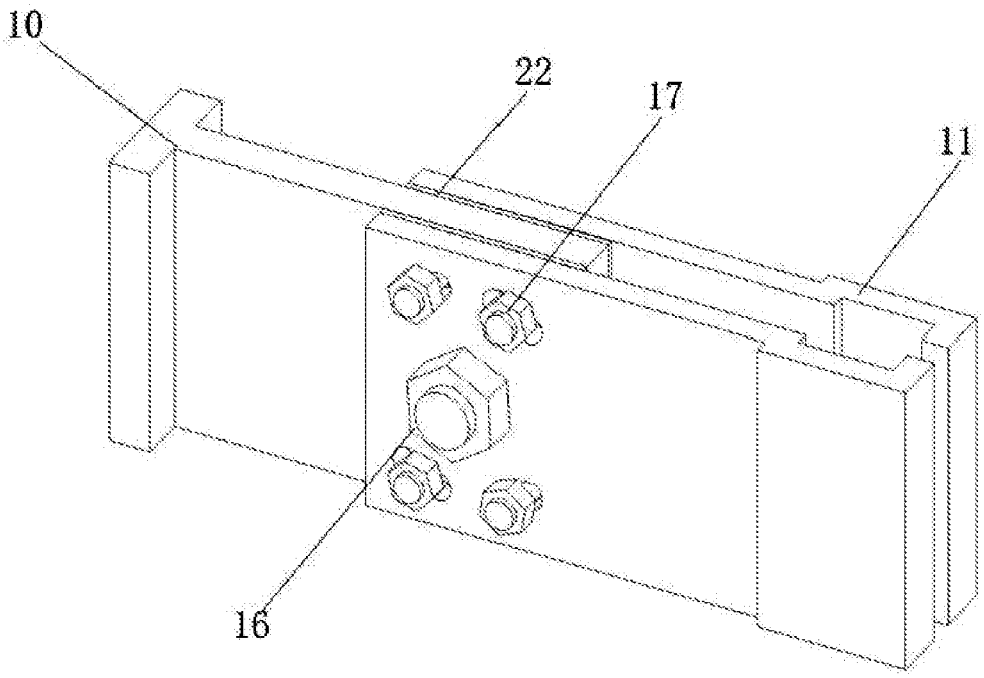
FIG. 6 is a structural schematic diagram of a friction energy dissipation damper of a beam-column joint of a prefabricated self-centering RC frame based on an SMA material in accordance with the present disclosure.
Figure 7:
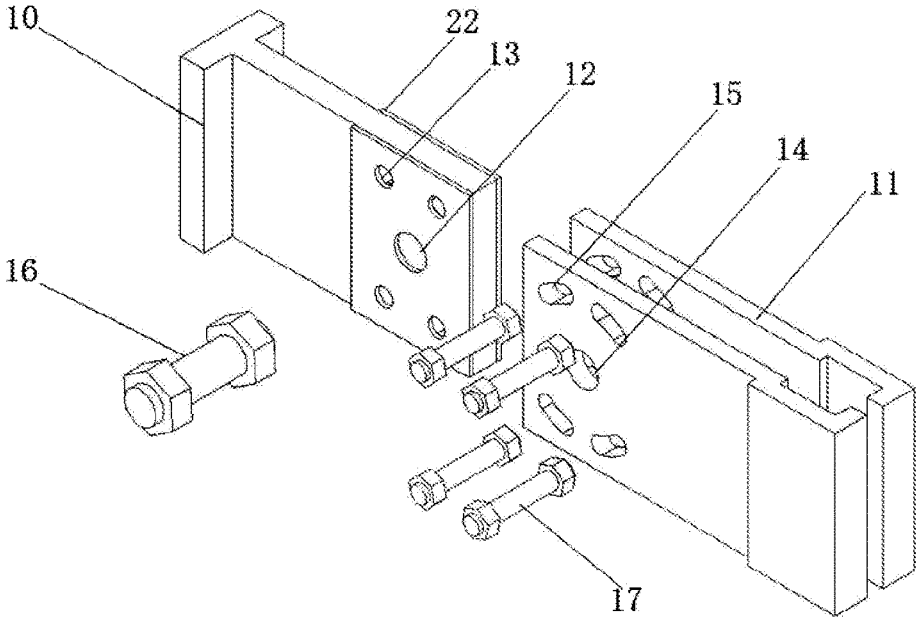
FIG. 7 is an exploded view of FIG. 5.

As shown in FIG. 6 and FIG. 7, the friction energy dissipation damper 24 includes an in-column embedded connecting plate 10 partially embedded inside the RC precast column 1 and beam-end embedded connecting plates 11 partially embedded inside the RC precast beam 2. Two beam-end embedded connection plates 11 are provided, which are arranged opposite and at intervals in the RC precast beam 2, with a mounting groove therebetween. The in-column embedded connecting plate 10 partially extends into the mounting groove. Hard friction plates 22 are attached on both sides of the end of the in-column embedded connecting plate 10 to increase initial stiffness of the joint and its energy dissipation capacity after rotation. The in-column embedded connecting plate 10 is provided with a column primary connecting hole 12 and four column secondary connecting holes 13 distributed in a circumferential direction of the column primary connecting hole 12. Similarly, the beam-end embedded connecting plate 11 is provided with a beam primary connecting hole 14 corresponding to the column primary connecting hole 12 and beam secondary connecting holes 15 in one-to-one correspondence with the column secondary connecting holes 13. Further, each of the beam secondary connecting holes 15 is an arc-shaped elongated hole. In the four secondary connecting holes, two beam secondary connecting holes 15 on the upper side and two beam secondary connecting holes 15 on the lower side are symmetrical in an up and down direction with respect to the beam primary connecting hole 14, and two beam secondary connecting holes 15 on the left side and two beam secondary connecting holes 15 on the right side are symmetrical in a left and right direction with respect to the beam primary connecting hole 14. The distribution of the column primary connecting hole 12 and the column secondary connecting holes 13 also follows the above law of the beam primary connecting hole 14 and the beam secondary connecting holes 15. A hole diameter of the column primary connecting hole 12 is equal to that of the beam primary connecting hole 14, and main shear bolts with adaptive size are arranged in the column primary connecting hole and the beam primary connecting hole in a penetrating manner. Auxiliary shear bolts 17 are arranged in the column secondary connection holes 13 and the corresponding beam secondary connection holes 15 in a penetrating manner. While increasing the number of the shear bolts and improving the shear bearing capacity of the joint, the relative rotation between the RC precast beam 1 and the RC precast column 2 is still allowed; and at the same time, the functions of limiting the maximum displacement angle of the beam-column joint, preventing the axial displacement of the SC-BRD from exceeding the limit, and promoting the RC precast beam 2 to participate in plastic deformation and share energy dissipation when the displacement angle of the joint is larger are also achieved.

Figure 8:
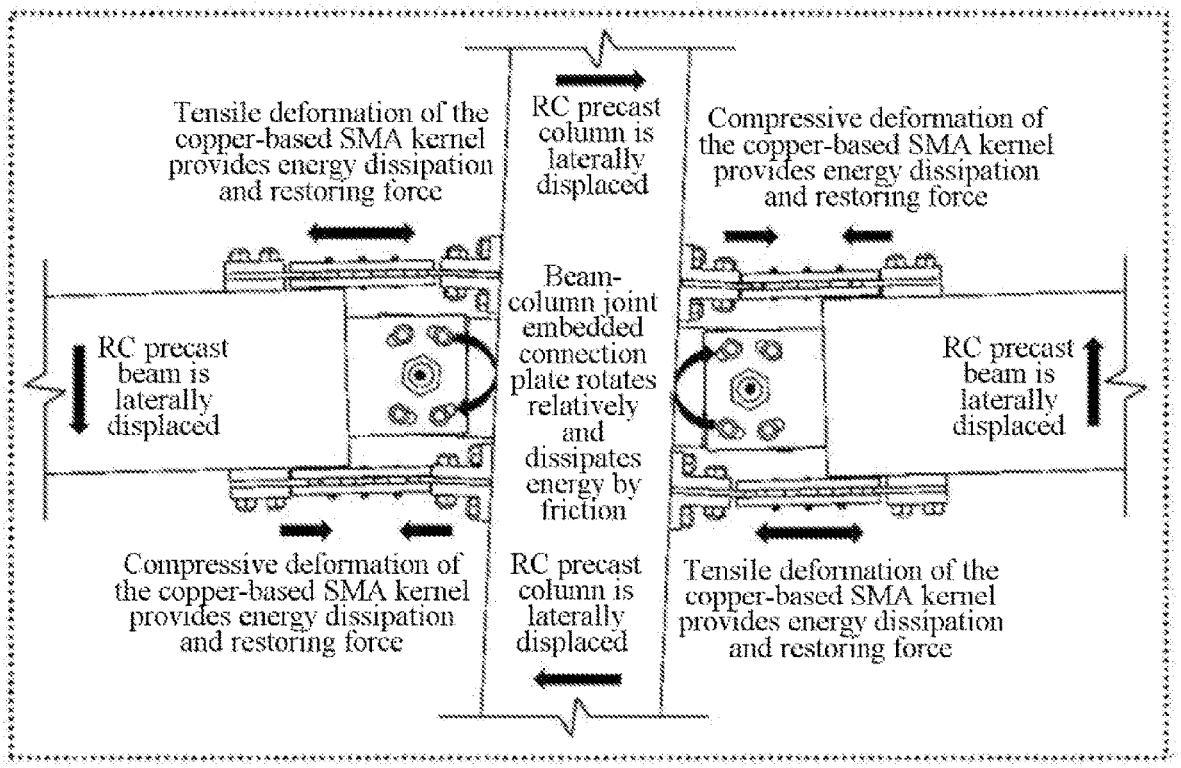
FIG. 8 is a schematic diagram of the seismic response of a beam-column joint of a prefabricated self-centering RC frame based on an SMA material in accordance with the present disclosure.

As shown in FIG. 8, the corresponding column-end connection reinforcing plates 6 in the self-centering energy dissipation dampers at the same position on the left and right sides of the same RC precast column 1 are connected to each other.

With reference to FIG. 8, the design anticipation deformation, the self-centering energy dissipation principle of each member of the beam-column joint of a prefabricated self-centering RC frame based on the SMA material, and the seismic performance targets of its frame structural system under the effect of various grades of seismic are as follows:

(1) when the frame is in a durable design condition such as frequent earthquakes, the RC precast beam 1, the RC precast column 2 and the self-centering energy dissipation dampers 23 on both sides of the joint remain elastic, and the hard friction plates 22 at the joint of the RC precast beam 1 and the RC precast column 2 do not rotate with respect to the beam-end embedded connecting plates 11, and the elastic stiffness is used to resist the vibration deformation by the whole frame. After a small earthquake, the structure of the frame has no damage and residual deformation, and the structure can be continued to use without repair after the earthquake;

(2) when the frame is excited by the intensity exceeding that of frequent earthquakes but less than that of rare earthquakes, the RC precast beam 1 and the RC precast column 2 still remain elastic. The hard friction plates 22 at the joint of the RC precast beam 1 and the RC precast column 2 begin to rotate with respect to the beam-end embedded connecting plate 11 so as to enhance the energy dissipation capacity of a "beam hinge". However, the copper-based SMA kernel in the self-centering energy dissipation damper 23 is in a super-elastic deformation range where the axial residual strain is almost zero and the strain amplitude is small. At this time, the energy dissipation capacity of the copper-based SMA kernel is small but the restoring stress after unloading is sufficient, which provides extra energy dissipation capacity and good post-earthquake self-centering capacity for the beam hinge, and then reduces or even eliminates the post-earthquake residual deformation of the precast frame structure. That is, after moderate earthquakes, the RC precast beam 2, the RC precast column 1 and other members have no damage, the residual deformation of the self-centering energy dissipation damper 23 is almost zero, and there is a small residual displacement angle between the hard friction plate 22 and the beam-end embedded connecting plate 11. After the earthquake, the structure does not need to be repaired, or can continue to be used only after releasing the prestress in the local shear bolts and correcting the tiny residual displacement angle between some of the hard friction plates 22 and the beam-end embedded connecting plate 11;

(3) when the frame structure is excited by the intensity of rare earthquakes, the RC precast beam 1 and the RC precast column 2 still remain elastic. The hard friction plates 22 at the joint of the RC precast beam 1 and the RC precast column 2 rotates with respect to the beam-end embedded connecting plate 11 at a large angle, so as to further enhance the energy dissipation capacity of the "beam hinge". However, the copper-based SMA kernel in the self-centering energy dissipation damper 23 has larger and nearly symmetric axial tension and compression yield deformations and hysteretic energy dissipation under the restraint of out-of-plane deformation of the restraint members. In this case, the energy dissipation capacity of the copper-based SMA kernel is significantly improved, and the restoring stress decreases, and the residual deformation increases after unloading, so as to provide sufficient hysteretic energy dissipation and good post-earthquake self-centering ability for the beam hinge, therefore reducing the post-earthquake residual deformation while controlling the seismic response of the frame structure. That is, after the large earthquake, the main beam and column members of the structure have no damage, the self-centering energy dissipation damper 23 has a small residual deformation, and there is a certain residual displacement angle between the hard friction plate 22 and the beam-end embedded connecting plate 11. After the earthquake, the structure can continue to be used after replacing only the self-centering energy dissipation damper with a larger axial deformation and correcting the shear bolt connection displacement angle with a larger residual deformation;

(4) when the frame structure is excited by the intensity of extremely rare earthquakes, the RC precast column 1 still remains elastic as excepted. Under the control of the secondary connection holes 15 at the left end of the beam-end embedded connecting plate 11, the shear bolt connection parts of the RC precast beam 2 and the RC precast column 1 reach the maximum displacement angle limit, and the self-centering energy dissipation damper 23 reaches the maximum axial deformation limit. The RC precast beam 2 begins to participate in plastic deformation, so as to maximize the energy dissipation capacity of the plastic deformation of the beam hinge, control the seismic response of the structure and the plastic damage of the precast column members, and make the structure still yield according to the overall mechanism to prevent the structure from collapsing.

The beam-column joint of a prefabricated self-centering RC frame based on an SMA material of the present disclosure can take the energy dissipation, self-centering ability and safety in consideration, and can be applied to different earthquake intensities, so as to achieve the targets of no damage in small earthquakes, easy-to-repair in moderate earthquakes, repairable in large earthquakes, no collapse in giant earthquakes. The possibility of continued use of a single structure after earthquake is improved, the high economic cost and great social impact caused by the strong earthquake can be reduced, and the rapid recovery of life and production after earthquake is accelerated.

In other embodiments, the SMA kernel may also be made of a nickel-titanium SMA material or an iron-manganese-silicon alloy material regardless of cost.

The above-mentioned embodiment of the present disclosure does not limit the scope of the present disclosure. Any modification, equivalent replacement, improvement, etc. made within the spirit and principles of the present disclosure should be included within the scope of the present disclosure.

What is claimed is:

1. A prefabricated Reinforced Concrete (RC) frame, comprising:

an RC precast column;

an RC precast beam; and a beam-column joint comprising:

self-centering energy dissipation dampers, wherein the self-centering energy dissipation dampers comprise two self-centering energy dissipation dampers arranged at an interval in an up-down direction, wherein the RC precast beam is arranged between the self-centering energy dissipation dampers;

each of the self-centering energy dissipation dampers comprises a Shape Memory Alloy (SMA) core, an upper restraint cover plate, a lower restraint cover plate, a column-end connection reinforcing plate and a beam-end connection reinforcing plate; the SMA core is connected between the upper restraint cover plate and the lower restraint cover plate, and a set energy dissipation gap is reserved between the SMA core and the upper restraint cover plate; the column-end connection reinforcing plate is connected to both the SMA core and the RC precast column by column-end high-strength bolts, and the beam-end connection reinforcing plate is connected to both the SMA core and the RC precast beam by beam-end high-strength bolts;

a friction energy dissipation damper, comprising a column connecting plate partially embedded in the RC precast column and a beam-end connecting plate partially embedded in the RC precast beam, wherein the column connecting plate and the beam-end connecting plate each are provided with a primary connecting hole and secondary connecting holes in one-to-one correspondence; the secondary connecting holes are distributed in a circumferential direction of the primary connecting hole, and each of the secondary connecting holes on the beam-end connecting plate is an arc-shaped elongated hole, and the primary connecting hole and the secondary connecting holes on each of the column connecting plate and the beam-end connecting plate are provided with shear bolts penetrating therethrough.

2. The prefabricated RC frame according to claim 1, wherein the SMA core is made of a copper-based shape memory alloy.

3. The prefabricated RC frame according to claim 1, wherein the friction energy dissipation damper further comprises hard friction plates attached to both sides of one end of the column connecting plate.

4. The prefabricated RC frame according to claim 1, wherein each of the column connecting plate and the beam-end connecting plate is provided with four secondary connecting holes; in each of the column connecting plate and the beam-end connecting plate, two secondary connecting holes on an upper side and two secondary connecting holes on a lower side are symmetrical in an up and down direction with respect to the primary connecting hole and two secondary connecting holes on a left side and two secondary connecting holes on a right side are symmetrical in a left and right direction with respect to the primary connecting hole.

5. The prefabricated RC frame according to claim 1, wherein column-end connection reinforcing plates in self-centering energy dissipation dampers at a same position on left and right sides of a same RC precast column are connected to each other.

6. The prefabricated RC frame according to claim 1, wherein the SMA core is a variable cross-section structure, comprising an energy dissipation section in a middle of the SMA core and connecting sections located at both ends of the SMA core, a width of the energy dissipation section is smaller than that of each of the connecting sections, the energy dissipation section is connected to the upper constraint cover plate and the lower constraint cover plate, and the connecting sections are connected to the column-end connection reinforcing plate and the beam-end connection reinforcing plate respectively.

7. The prefabricated RC frame according to claim 6, wherein the energy dissipation section is provided with an elongated hole extending in a length direction thereof, the lower restraint cover plate is provided with pads at positions corresponding to the elongated hole and edges of the energy dissipation section in a width direction, and a thickness of each of the pads is greater than that of the energy dissipation section; the upper restraint cover plate is provided with through holes at positions corresponding to the pads.

8. The prefabricated RC frame according to claim 7, wherein the thickness of each of the pads is greater than that of the energy dissipation section by 1 mm.

9. The prefabricated RC frame according to claim 6, wherein the SMA core is made of a copper-based shape memory alloy.

10. The prefabricated RC frame according to claim 7, wherein the SMA core is made of a copper-based shape memory alloy.

11. The prefabricated RC frame according to claim 8, wherein the SMA core is made of a copper-based shape memory alloy.

12. The prefabricated RC frame according to claim 6, wherein the friction energy dissipation damper further comprises hard friction plates attached to both sides of one end of the column connecting plate.

13. The prefabricated RC frame according to claim 7, wherein the friction energy dissipation damper further comprises hard friction plates attached to both sides of one end of the column connecting plate.

14. The prefabricated RC frame according to claim 8, wherein the friction energy dissipation damper further comprises hard friction plates attached to both sides of one end of the column connecting plate.

15. The prefabricated RC frame according to claim 6, wherein each of the column connecting plate and the beam-end connecting plate is provided with four secondary connecting holes; in each of the column connecting plate and the beam-end connecting plate, two secondary connecting holes on an upper side and two secondary connecting holes on a lower side secondary connecting holes on a left side and two secondary connecting holes on a right side are symmetrical in a left and right direction with respect to the primary connecting hole.

16. The prefabricated RC frame according to claim 7, wherein each of the column connecting plate and the beam-end connecting plate is provided with four secondary connecting holes; in each of the column connecting plate and the beam-end connecting plate, two secondary connecting holes on an upper side and two secondary connecting holes on a lower side are symmetrical in an up and down direction with respect to the primary connecting hole and two secondary connecting holes on a left side and two secondary connecting holes on a right side are symmetrical in a left and right direction with respect to the primary connecting hole.

17. The prefabricated RC frame according to claim 8, wherein each of the column connecting plate and the beam-end connecting plate is provided with four secondary connecting holes; in each of the column connecting plate and the beam-end connecting plate, two secondary connecting holes on an upper side and two secondary connecting holes on a lower side are symmetrical in an up and down direction with respect to the primary connecting hole and two secondary connecting holes on a left side and two secondary connecting holes on a right side are symmetrical in a left and right direction with respect to the primary connecting hole.

18. The prefabricated RC frame according to claim 6, wherein column-end connection reinforcing plates in self-centering energy dissipation dampers at a same position on left and right sides of a same RC precast column are connected to each other.

19. The prefabricated RC frame according to claim 7, wherein column-end connection reinforcing plates in self-centering energy dissipation dampers at a same position on left and right sides of a same RC precast column are connected to each other.

20. The prefabricated RC frame according to claim 8, wherein column-end connection reinforcing plates in self-centering energy dissipation dampers at a same position on left and right sides of a same RC precast column are connected to each other.

* * * * *